US005755245A

United States Patent [19]

Van Helvoort

[11] Patent Number: 5,755,245

[45] Date of Patent: May 26, 1998

[54] WALKING STICK

[76] Inventor: Joannes A. M. C. Van Helvoort, Westrik 3, NL-4841 BM Prinsenbeek, Netherlands

[21] Appl. No.: 800,145

[22] Filed: Feb. 13, 1997

[30] Foreign Application Priority Data

Oct. 17, 1996 [NL] Netherlands ..... 1004305

[51] Int. Cl.[6] ..... A45B 3/00

[52] U.S. Cl. ..... 135/70; 135/65; 135/66; 135/69; 135/77; 135/79; 135/911

[58] Field of Search ..... 135/65, 66, 69, 135/70, 76, 77, 79, 911

[56] References Cited

U.S. PATENT DOCUMENTS

| | | | |
|---|---|---|---|
| 2,346,038 | 4/1944 | Mason | 135/66 X |
| 3,158,851 | 11/1964 | Ruthven | 135/66 X |
| 3,763,872 | 10/1973 | Gooley | 135/66 |
| 4,811,750 | 3/1989 | McAllister | 135/66 |
| 4,827,956 | 5/1989 | Toot | 135/66 |
| 4,966,316 | 10/1990 | George et al. | 135/66 X |
| 5,176,160 | 1/1993 | Osborn | 135/70 X |
| 5,392,800 | 2/1995 | Sergi | 135/77 X |
| 5,433,234 | 7/1995 | Lapere | 135/77 X |
| 5,636,650 | 6/1997 | Kroeze | 135/77 X |
| 5,640,985 | 6/1997 | Snyder et al. | 135/66 X |

FOREIGN PATENT DOCUMENTS 9401235 7/1994 Netherlands .

*Primary Examiner*—Wynn E. Wood
*Attorney, Agent, or Firm*—Banner & Witcoff, Ltd.

[57] ABSTRACT

The present invention relates to an elongate support element, such as a walking stick, crutch or umbrella stick, comprising an elongate hollow stick which is provided on its underside with two supporting legs which are tiltable between a folded-in position and a folded-out, active position, wherein on the upper part of the stick an actuating element is arranged for actuating the supporting legs and the actuating element is connected to a drive member extending through the hollow stick, wherein the drive member comprises a rod extending through the hollow stick and provided on its underside with a gear rack in addition to pinions each connected to a leg and engaging in the gear rack.

According to a preferred embodiment a stick is therefore provided on its underside with a piece in which the legs are rotatably mounted and in which the transverse wall is arranged through which the rod extends, which transverse wall also functions as stop means for limiting the movement of the legs in the folded-out position.

15 Claims, 3 Drawing Sheets

WALKING STICK

BACKGROUND OF THE INVENTION

The present invention relates to an elongate support element, such as a walking stick, crutch or umbrella stick, comprising an elongate hollow stick which is provided on its underside with two supporting legs which are tiltable between a folded-in position and a folded-out, active position, wherein on the upper part of the stick an actuating element is arranged for actuating the supporting legs and the actuating element is connected to a drive member extending through the hollow stick.

Such an elongate support element is known from the Netherlands patent application 94.01235.

Such a support element in the form of a crutch, walking stick or umbrella is put down rather often during use because the user wishes to have his hands free.

Such a situation occurs for instance in shops when the user wishes to have his hands free. Usually there is then no wall or object against which the stick can be placed, or possibly available walls or objects are so smooth that the support element cannot be placed properly against them. This problem occurs for instance in shops, wherein it is not usually possible to place such a support element against a display counter without it falling over.

The support element described in the above mentioned publication provides a solution herefor by providing the element with outward foldable supporting legs, whereby the user can put down the support element in question.

In the prior art support element the legs are actuated by means of a lever mechanism. Experience has shown that this lever mechanism is susceptible to considerable wear, whereafter play results herein and the position of the outward foldable supporting legs is not adequately ensured, and the stick does not stand securely.

SUMMARY OF THE INVENTION

The object of the present invention is to provide an elongate support element wherein the above stated drawbacks are avoided.

This object is achieved in that the drive member comprises a rod extending through the hollow stick and provided on its underside with a gear rack in addition to pinions each connected to a leg and engaging in the gear rack.

As a consequence of these steps it is possible to avoid play. The mechanism is moreover less susceptible to wear.

Another advantage is that this construction permits more adjustment options so that, should play occur, it can easily be corrected.

According to a preferred embodiment a stick is therefore provided on its underside with a piece in which the legs are rotatably mounted and in which the transverse wall is arranged through which the rod extends, which transverse wall also functions as stop means for limiting the movement of the legs in the folded-out position.

According to another preferred embodiment the handle of the support element is connected to a sleeve which is slidable over the stick in axial direction of the stick and the sleeve is connected on its inside to the rod. This results in a particularly attractive construction.

According to yet another preferred embodiment two holes are arranged in the sleeve and a stopping element is arranged in the rod, which element is urged outward by a spring and adapted to extend through one of the holes. A construction which is easily stopped is thus obtained.

According to yet another preferred embodiment the holes and the stopping element are sealed by a layer of flexible material. The device hereby becomes rather easier to use; depressing of the stopping element is hereby perceived to a lesser extent as being disagreeable.

The present invention will be elucidated hereinbelow with reference to the annexed drawings.

DETAILED DESCRIPTION OF THE INVENTION

Figure 1:
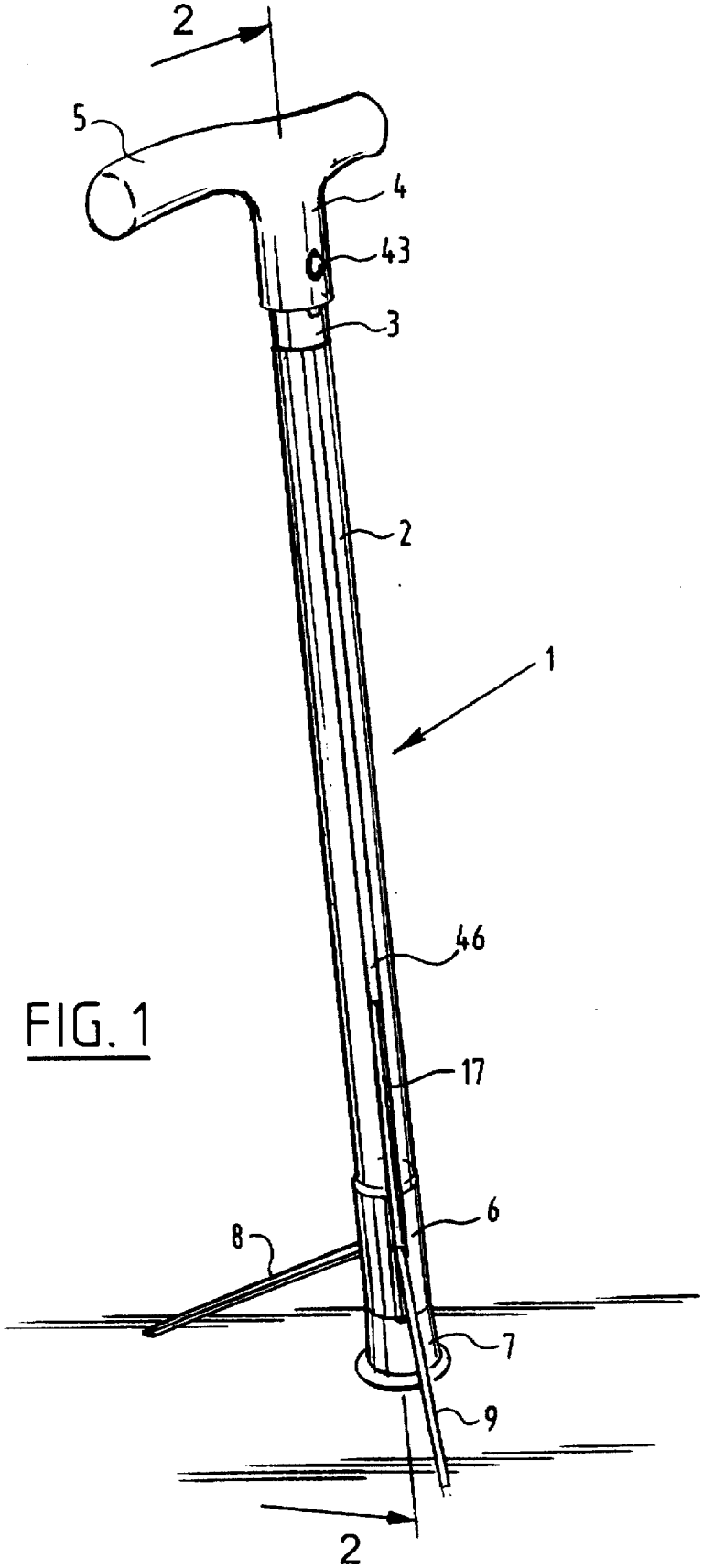
FIG. 1 shows a perspective view of a walking stick according to the invention.

Shown in FIG. 1 is a walking stick 1 which is formed by the actual stick 2 which is provided on its upper part with a narrowing 3 on which is arranged a sleeve 4 which is closed at its top by a handle 5. On its underside the stick 2 is connected to a thickened piece 6 which runs out into a tapering foot 7. Further arranged are two supporting legs 8,9 which can be folded back into cavities 17 arranged for this purpose, wherein the cavity for the leg 9 is not shown.

Further shown is a stop button 43.

Figure 2:
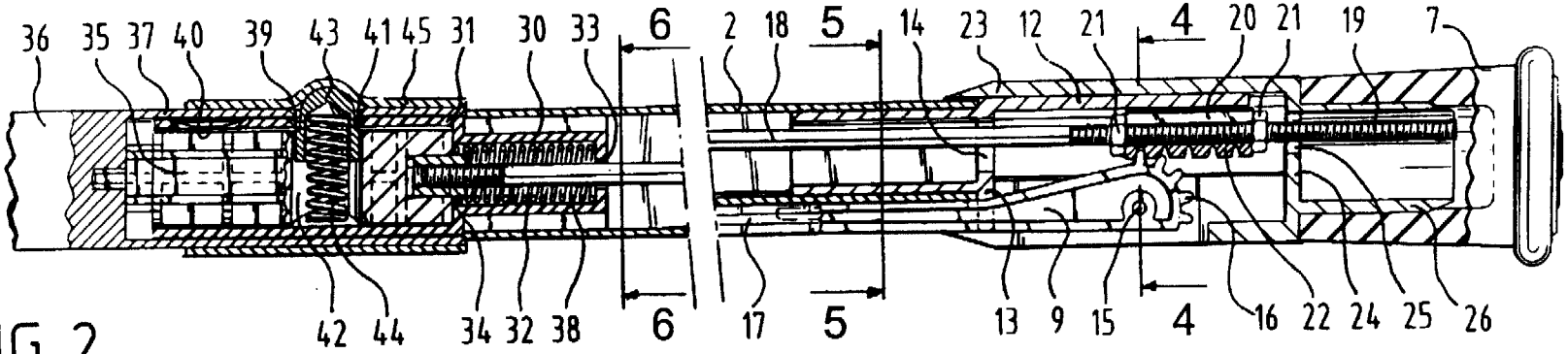
FIG. 2 shows a cross-sectional view of the walking stick depicted in FIG. 1 on the underside with folded-in supporting legs.

FIG. 2 shows a lengthwise section along the line II—II. This shows that the actual stick 2 is connected on its underside to a piece 12 in which is arranged a transverse wall 13 which is provided with an opening 14. Further arranged in the piece are two shafts, only one of which, 15, is shown. This shaft is mounted in piece 12 and the leg 9 is also mounted on the shaft. Leg 9 is provided on its mounted side with a pinion 16. The leg 9, which is shown in FIG. 2 in the folded-in situation, extends in this situation in the cavity 17 arranged in stick 2.

In order to actuate the inward respectively outward folding of legs 8,9 use is made of a rod 18 extending through the hollow stick 2. Rod 18 herein extends through the opening 14. At its bottom end the rod 18 is provided with a screw thread 19 onto which a slide piece 20 is fixed by means of two nuts 21. Slide piece 20 rests on one side against an inner wall of piece 12 and is provided on its other side with a gear rack 22. The rack 22 engages in the pinion 16 of leg 9.

Arranged around piece 12 is a thickening piece 23 which is fixed to piece 12 by way of suitable means, for instance by glueing or welding. The thickening piece 23 is provided on its underside with a transverse wall 24 in which is arranged an opening 25 through which extends the lower part of the actuating rod 18. The thickening piece 23 is further provided on its underside with a skirt 26 onto which is pushed the foot 7, which is manufactured for instance from rubber.

At the top of the stick 2 a plug 30 is arranged which runs out at its top into a cylinder 31. In plug 30 is arranged a cavity 32 which runs out into a thin hole 33. Actuating rod 18, which otherwise extends eccentrically in the lower part of the stick and centrally in the upper part of the stick, extends through hole 33 and the cavity 32 arranged in plug 30. On its upper part the actuating rod 18 is provided with screw thread 34 whereby actuating rod 18 is connected to a stopper 35 movable in the cylinder 31. The movement of stopper 35 inside cylinder 31 is therefore coupled to that of actuating rod 18.

At its top the plug 35 is coupled to the handle 36. This latter is provided on its underside with a skirt 37 extending round cylinder 31. Arranged in cavity 31 between stopper 35 and plug 30 is a helical spring 38 with which the stopper 35 is urged upward.

In order to stop the stopper 35 relative to the cylinder 31 connected to stick 2, two holes 39,40 are arranged in cylinder 31, wherein a hole 41 is moreover arranged in the skirt 37.. Further arranged in the stopper is a cylindrical transverse cavity 42 in which a push-button 43 provided with a semi-arcuate top is slidably mounted. A helical spring 44 is arranged between button 43 and the wall of cavity 42.

Depending on the position of the stopper 35 relative to the stick 2 the stop button 43 can herein extend through one of the openings 40, 39 respectively and at all times through the opening 41 arranged in the skirt 37, since the movement of stop button 43 coincides with that of skirt 37.

Figure 3:
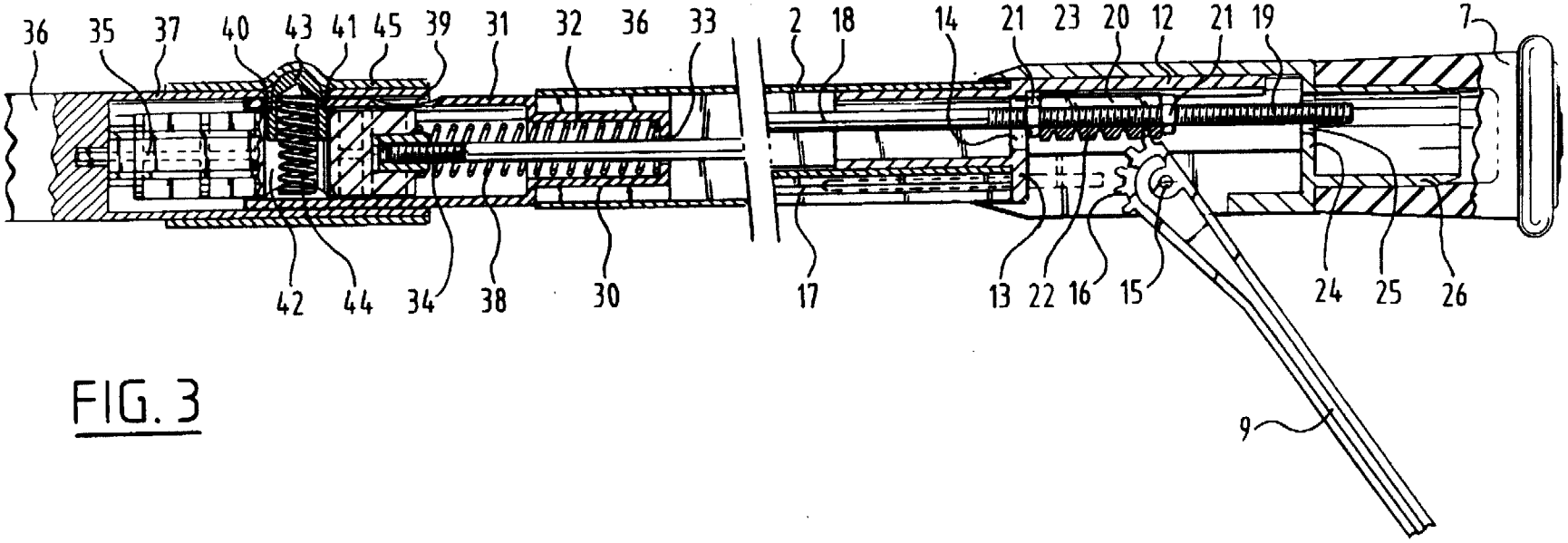
FIG. 3 is a cross-sectional view corresponding with FIG. 2 with folded-out supporting legs.
Figure 4:
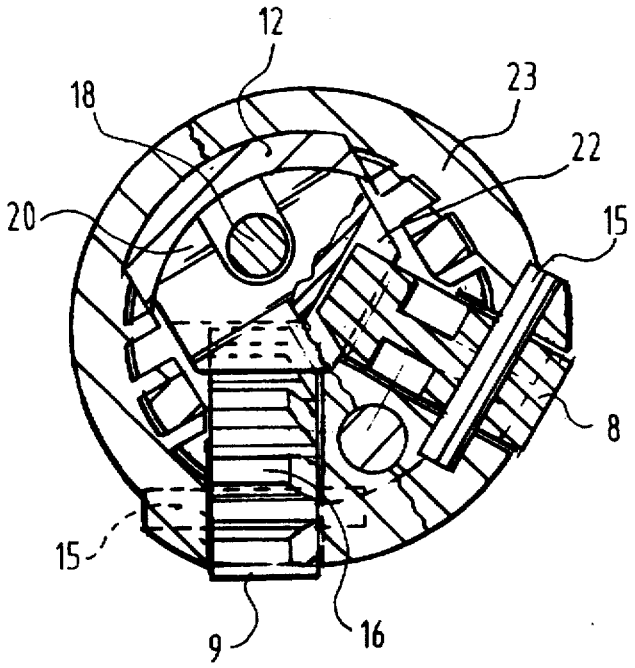
FIG. 4 shows a cross-sectional view along the line IV—IV in FIG. 2.
Figure 5:
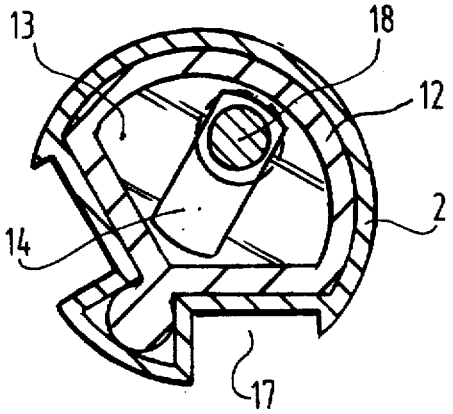
FIG. 5 shows a cross-sectional view along the line V—V in FIG. 2.
Figure 6:
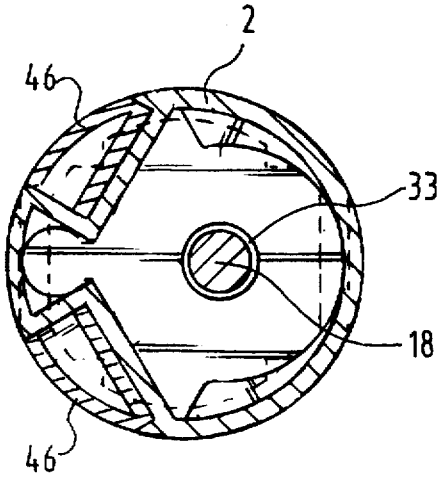
FIG. 6 shows a cross section along the line VI—VI in FIG. 2.

This mechanism thus provides the option of positioning the actuating rod 18 in two positions relative to that of the stick 2, wherein in the first, upper position the stop button 43 extends through opening 40, as shown in FIG. 3, and the legs are folded out, and in the second position the stop button 43 extends through the lower opening 41 and the legs are folded in, as shown in FIG. 2.

Thus obtained herewith is a mechanism for folding the legs in and out which is reliable, readjustable and little subject to wear.

As stated, it is possible according to a preferred embodiment to arrange a layer of flexible material on the outside of the skirt 37, as is designated with 45 in FIG. 2.

Finally, attention is drawn to the fact that the actual stick 2 is manufactured from an extruded, non-round profile in order to provide space for the recesses 17 for the folded-in legs. In the higher part of the stick these are filled with filling pieces 46. Thus obtained is a walking stick of which most components can be manufactured from diverse materials such as aluminium, in particular the extruded components, or plastic which may or may not be reinforced with glass fibres.

I claim:

1. An elongated support element comprising an elongated hollow stick having upper and lower parts which is provided on its lower part with two supporting legs which are tiltable between a folded-in position and a folded-out, active position, wherein on the upper part of the stick an actuating element is arranged for actuating the supporting legs and the actuating element is connected to a drive member extending through the hollow stick, characterized in that the drive member comprises a rod having an upper and lower end extending through the hollow stick and provided on its lower end with a gear rack, each said supporting leg including a pinion connected thereto and engaging in the gear rack.

2. Elongated support element as claimed in claim 1, characterized in that the gear rack is provided with two sets of teeth, one for each leg pinion.

3. Elongate support element as claimed in claim 1, characterized in that the gear rack is arranged on a separate element which is fixed to a screw thread on the underside of the rod by means of locking nuts.

4. Elongate support element as claimed in claim 1, characterized in that the stick is provided on its underside with a piece in which the legs are rotatably mounted and in which a transverse wall is arranged through which the rod extends, which transverse wall also functions as stop means for limiting the movement of the legs in the folded-out position.

5. Elongate support element as claimed in claim 1, characterized in that the handle is connected to a sleeve which is slidable over the stick in axial direction of the stick and the sleeve is connected on its inside to the rod.

6. Elongate support element as claimed in claim 5, characterized in that on the upper part of the stick is arranged a plug through which the rod extends and that a helical spring extending round the rod is arranged between the sleeve and the plug.

7. Elongate support element as claimed in claim 5, characterized in that two holes are arranged in the sleeve and a stopping element is arranged in the rod, which element is urged outward by a spring and adapted to extend through one of the holes.

8. Elongate support element as claimed in claim 7, characterized in that the holes and the stopping element are sealed by a layer of flexible material.

9. Elongate support element as claimed in claim 2, characterized in that the gear rack is arranged on a separate element which is fixed to a screw thread on the underside of the rod by means of locking nuts.

10. Elongate support element as claimed in claim 2, characterized in that the stick is provided on its underside with a piece in which the legs are rotatably mounted and in which a transverse wall is arranged through which the rod extends, which transverse wall also functions as stop means for limiting the movement of the legs in the folded-out position.

11. Elongate support element as claimed in claim 3, characterized in that the stick is provided on its underside with a piece in which the legs are rotatably mounted and in which a transverse wall is arranged through which the rod extends, which transverse wall also functions as stop means for limiting the movement of the legs in the folded-out position.

12. Elongate support element as claimed in claim 2, characterized in that the handle is connected to a sleeve which is slidable over the stick in axial direction of the stick and the sleeve is connected on its inside to the rod.

13. Elongate support element as claimed in claim 3, characterized in that the handle is connected to a sleeve which is slidable over the stick in axial direction of the stick and the sleeve is connected on its inside to the rod.

14. Elongate support element as claimed in claim 4, characterized in that the handle is connected to a sleeve which is slidable over the stick in axial direction of the stick and the sleeve is connected on its inside to the rod.

15. Elongate support element as claimed in claim 6, characterized in that two holes are arranged in the sleeve and a stopping element is arranged in the rod, which element is urged outward by a spring and adapted to extend through one of the holes.

* * * * *